US010323213B2

(12) United States Patent
Vockenroth et al.

(10) Patent No.: US 10,323,213 B2
(45) Date of Patent: Jun. 18, 2019

(54) DETERGENT CONTAINING AMINE OXIDE

(71) Applicant: Henkel AG & Co. KGaA, Duesseldorf (DE)

(72) Inventors: Inga Kerstin Vockenroth, Duesseldorf (DE); Eva-Maria Wikker, Monheim (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/006,394

(22) Filed: Jan. 26, 2016

(65) Prior Publication Data

US 2016/0186095 A1 Jun. 30, 2016

Related U.S. Application Data

(63) Continuation of application No. PCT/EP2014/065553, filed on Jul. 18, 2014.

(30) Foreign Application Priority Data

Jul. 24, 2013 (DE) ..... 10 2013 214 472

(51) Int. Cl.

| | |
|---|---|
| ***C11D 1/00*** | (2006.01) |
| ***C11D 1/83*** | (2006.01) |
| ***C11D 1/22*** | (2006.01) |
| ***C11D 1/75*** | (2006.01) |
| ***C11D 11/00*** | (2006.01) |
| ***C11D 1/14*** | (2006.01) |
| ***C11D 1/66*** | (2006.01) |
| *C11D 1/29* | (2006.01) |
| *C11D 1/72* | (2006.01) |

(52) U.S. Cl.

CPC ..... *C11D 1/83* (2013.01); *C11D 1/146* (2013.01); *C11D 1/22* (2013.01); *C11D 1/66* (2013.01); *C11D 1/75* (2013.01); *C11D 11/0017* (2013.01); *C11D 1/29* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 6,162,778 A * | 12/2000 | McKillop | ..... | C11D 3/38618 134/25.2 |
| 7,906,471 B2 * | 3/2011 | Wiedemann | ..... | C11D 3/0026 510/220 |
| 2015/0099684 A1 * | 4/2015 | Boutique | ..... | C11D 1/83 510/293 |

FOREIGN PATENT DOCUMENTS

| | | |
|---|---|---|
| WO | 2006/026131 A1 | 3/2006 |
| WO | 2008/012141 A2 | 1/2008 |

OTHER PUBLICATIONS

PCT International Search Report (PCT/EP2014/065553) dated Oct. 24, 2014.

* cited by examiner

*Primary Examiner* — Necholus Ogden, Jr.
(74) *Attorney, Agent, or Firm* — Thomas G. Krivulka

(57) ABSTRACT

The present application relates to a detergent with an improved cleaning performance, in particular on greasy stains, said detergent comprising a surfactant mixture containing amine oxide, alkylbenzene sulfonate, alkyl ether sulfate, and fatty alcohol ethoxylate. The invention also relates to the use of said detergent and to a method for improving the cleaning performance of a detergent.

6 Claims, No Drawings

DETERGENT CONTAINING AMINE OXIDE

FIELD OF THE INVENTION

The present invention generally relates to a detergent, containing amine oxide, with an improved cleaning performance, particularly on greasy stains, and a method for improving the cleaning performance of a detergent.

BACKGROUND OF THE INVENTION

The use of various surfactants in detergents has been established in the prior art. They serve as wash-active substances to increase the solubility in water of fat and dirt particles adhering to laundry items. Because an insufficient cleaning performance is unsatisfactory and leads to consumer dissatisfaction, it is a general aim to optimize the cleaning performance of detergents further.

The object of the present invention, therefore, is to provide a detergent with an improved cleaning performance, particularly on greasy stains.

It was found surprisingly that the cleaning performance of detergents is significantly improved, particularly with respect to the cleaning performance thereof on greasy stains, if the detergent contains, in addition to other surfactant components, amine oxide in a specific quantity ratio based on the other surfactants present in the detergent, particularly alkylbenzene sulfonate, alkyl ether sulfate, and fatty alcohol alkoxylate.

Moreover, it became evident surprisingly that, apart from the improved cleaning performance on greasy stains with a simultaneous reduction of the total surfactant content, a drop in performance on bleachable, enzymatic, and surfactant stains can be prevented by selecting a specific quantity ratio of the surfactants: amine oxide, alkylbenzene sulfonate, alkyl ether sulfate, and fatty alcohol alkoxylate. Thus, the disclosed detergent is advantageous in addition, because the environment is protected and the use of raw materials becomes more sustainable and the production more economic.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A detergent, preferably a liquid detergent, containing a surfactant mixture, wherein the surfactant mixture comprises: 5% by weight to 20% by weight of amine oxide, 10% by weight to 60% by weight of alkylbenzene sulfonate, 12.5% by weight to 70% by weight of alkyl ether sulfate, and 10% by weight to 60% by weight of fatty alcohol alkoxylate, in each case based on the surfactant mixture, wherein the weight ratio of amine oxide to alkylbenzene sulfonate is 1:2 to 1:3, preferably 1:2.1 to 1:2.5; the weight ratio of amine oxide to alkyl ether sulfate is 1:2.5 to 1:3.5, preferably 1:2.8 to 1:3.2; and the weight ratio of amine oxide to fatty alcohol alkoxylate is 1:2 to 1:3, preferably 1:2.1 to 1:2.5.

Use of amine oxide for improving the cleaning performance, particularly on greasy stains, of a detergent, particularly a liquid detergent, wherein the detergent contains a surfactant mixture, which comprises: 5% by weight to 20% by weight of amine oxide, 10% by weight to 60% by weight of alkylbenzene sulfonate, 12.5% by weight to 70% by weight of alkyl ether sulfate, and 10% by weight to 60% by weight of fatty alcohol alkoxylate, in each case based on the surfactant mixture, wherein the weight ratio of amine oxide to alkylbenzene sulfonate is 1:2 to 1:3, preferably 1:2.1 to 1:2.5; the weight ratio of amine oxide to alkyl ether sulfate is 1:2.5 to 1:3.5, preferably 1:2.8 to 1:3.2; and the weight ratio of amine oxide to fatty alcohol alkoxylate is 1:2 to 1:3, preferably 1:2.1 to 1:2.5.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In a first aspect, the present invention is directed to a detergent, preferably a liquid detergent, containing a surfactant mixture, the surfactant mixture comprising:

a) 5% by weight to 20% by weight of amine oxide, b) 10% by weight to 60% by weight of alkylbenzene sulfonate, c) 12.5% by weight to 70% by weight of alkyl ether sulfate, and d) 10% by weight to 60% by weight of fatty alcohol alkoxylate, in each case based on the surfactant mixture, whereby i) the weight ratio of amine oxide to alkylbenzene sulfonate is 1:2 to 1:3, preferably 1:2.1 to 1:2.5, ii) the weight ratio of amine oxide to alkyl ether sulfate is 1:2.5 to 1:3.5, preferably 1:2.8 to 1:3.2, and iii) the weight ratio of amine oxide to fatty alcohol alkoxylate is 1:2 to 1:3, preferably 1:2.1 to 1:2.5.

In a further aspect, the present invention relates to the use of a detergent described herein as a laundry detergent.

In a still further aspect, the invention is directed to a washing method comprising the process steps:

i) providing a wash solution comprising a detergent, preferably a liquid detergent, as defined above; and ii) bringing a textile into contact with the wash solution according to (i).

Furthermore, the use of at least one amine oxide for improving the cleaning performance, particularly the cleaning performance on greasy stains, of a detergent, particularly a liquid detergent, which comprises at least one alkylbenzene sulfonate, at least one alkyl ether sulfate, and at least one fatty alcohol alkoxylate, is also the subject of the present invention. Within the scope of such a use, the detergent can contain the individual surfactant components in the amounts and ratios disclosed above in regard to the detergent.

It was found that a very good cleaning performance, particularly on greasy stains, can be achieved by the use of the described detergent even at low temperatures such as, for example, 20° C.

Cleaning performance (detergency) within the context of the invention is understood as the removal of one or more stains, particularly laundry stains, which are bleach-sensitive, enzyme-sensitive, and/or surfactant-sensitive. The removal can be both determined by measurement and evaluated visually from a lightening of the stain.

As already described above, the total surfactant content of the detergent can be reduced by the use of amine oxide or by the selection of the ratios of amine oxide and alkylbenzene sulfonate, alkyl ether sulfate, and fatty alcohol alkoxylate without adversely affecting the cleaning performance.

The advantages of the combination of components (a) amine oxide and (b) alkylbenzene sulfonate, alkyl ether sulfate, and fatty alcohol alkoxylate are present during use of the detergent, i.e., in the washing liquor. The washing liquor is understood to mean the detergent-containing use solution that acts on the textiles or fabrics and thereby comes into contact with the stains present on the textiles or fabrics. The washing liquor typically forms when the washing process begins and the detergent is dissolved in water or diluted with water, for example, in a washing machine or some other suitable container.

The compositions described herein comprise at least one amine oxide, but can also comprise a plurality of amine oxides. In principle, all amine oxides established for these purposes in the prior art, therefore compounds having the formula $R^1R^2R^3NO$, where each $R^2$, and $R^3$ independently of the others is an optionally substituted $C_1$-$C_{30}$ hydrocarbon chain, can be used in this regard. Amine oxides, used especially preferably, are those in which $R^1$ is $C_{12}$-$C_{18}$ alkyl and $R^2$ and $R^3$ are each independently $C_1$-$C_4$ alkyl, particularly $C_{12}$-$C_{18}$ alkyl dimethylamine oxides. Exemplary representatives of suitable amine oxides are N-coco alkyl-N, N-dimethylamine oxide, N-tallow alkyl-N,N-dihydroxyethylamine oxide, myristyl-/cetyldimethylamine oxide, or lauryldimethylamine oxide.

"At least one," as used herein, refers to 1 or more, for example, 1, 2, 3, 4, 5, 6, 7, 8, 9, or more.

Further, the detergent comprises at least one alkylbenzene sulfonate. Such alkylbenzene sulfonates are preferably selected from linear or branched alkylbenzene sulfonates of the formula

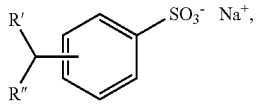

in which R' and R" independently are H or alkyl and together contain 9 to 19, preferably 9 to 15, and especially 9 to 13 C atoms. A very especially preferred representative is sodium dodecylbenzene sulfonate.

Further, the detergent comprises at least one alkyl ether sulfate. Preferred alkyl ether sulfates are those of the formula $$R^1\text{—O-(AO)}_n\text{—SO}_3^-X^+.$$

In this formula, $R^1$ stands for a linear or branched, substituted or unsubstituted alkyl group, preferably for a linear, unsubstituted alkyl group, especially preferably for a fatty alcohol group. Preferred $R^1$ groups are selected from decyl, undecyl, dodecyl, tridecyl, tetradecyl, pentadecyl, hexadecyl, heptadecyl, octadecyl, nonadecyl, and eicosyl groups and mixtures thereof, representatives with an even number of C atoms being preferred. Especially preferred $R^1$ groups are derived from $C_{12}$-$C_{18}$ fatty alcohols, for example, from coconut fatty alcohol, tallow fatty alcohol, lauryl, myristyl, cetyl, or stearyl alcohol, or from $C_{10}$-$C_{20}$ oxo alcohols.

AO stands for an ethylene oxide (EO) or propylene oxide (PO) group, preferably for an ethylene oxide group. The subscript n stands for an integer from 1 to 50, preferably from 1 to 20, and especially from 2 to 10. Very especially preferably n stands for the numbers 2, 3, 4, 5, 6, 7, or 8. X stands for a monovalent cation or the n-th part of an n-valent cation; alkali metal ions are preferred in this case and of these $Na^+$ or $K^+$, whereby $Na^+$ is extremely preferred. Other cations $X^+$ can be selected from $NH_4^+$, ½ $Zn^{2+}$, ½$Mg^{2+}$, ½$Ca^{2+}$, ½$Mn^{2+}$, and mixtures thereof.

Especially preferred detergents contain an alkyl ether sulfate selected from fatty alcohol ether sulfates of the formula

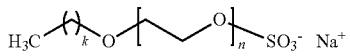

with k=11 to 19, n=2, 3, 4, 5, 6, 7, or 8. Very especially preferred representatives are $C_{12-14}$ fatty alcohol ether sulfates with 2 EO (k=11-13, n=2) and in this regard especially the Na salts thereof. The cited degree of ethoxylation represents a statistical average, which for a special product can be an integer or a fraction.

The detergents described herein, moreover, comprise at least one fatty alcohol alkoxylate. Preferred detergents therefore contain at least one nonionic surfactant of the formula $$R^2\text{—O-(AO)}_m\text{—H},$$

in which $R^2$ stands for a linear or branched, substituted or unsubstituted alkyl group, AO stands for an ethylene oxide (EO) or propylene oxide (PO) group, m stands for integers from 1 to 50.

In the aforementioned formula, $R^2$ stands for a linear or branched, substituted or unsubstituted alkyl group, preferably for a linear, unsubstituted alkyl group, especially preferably for a fatty alcohol group. Preferred $R^2$ groups are selected from decyl, undecyl, dodecyl, tridecyl, tetradecyl, pentadecyl, hexadecyl, heptadecyl, octadecyl, nonadecyl, and eicosyl groups and mixtures thereof, representatives with an even number of C atoms being preferred. Especially preferred $R^2$ groups are derived from $C_{12}$-$C_{18}$ fatty alcohols, for example, from coconut fatty alcohol, tallow fatty alcohol, lauryl, myristyl, cetyl, or stearyl alcohol, or from $C_{10}$-$C_{20}$ oxo alcohols.

AO stands for an ethylene oxide (EO) or propylene oxide (PO) group, preferably for an ethylene oxide group. The subscript n stands for an integer from 1 to 50, preferably from 1 to 20, and especially from 2 to 10. Very especially preferably m stands for the numbers 2, 3, 4, 5, 6, 7, or 8.

In summary, especially preferred fatty alcohol alkoxylates are those of the formula C-1

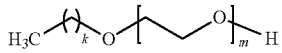

(C-1)

with k=11 to 19, m=2, 3, 4, 5, 6, 7, or 8. Very especially preferred representatives are $C_{12-18}$ fatty alcohols with 7 EO (k=11-17, m=7 in formula C-1).

In different embodiments, the concentration of the amine oxide in the surfactant mixture is 7.5% by weight to 17% by weight, preferably 10% by weight to 15% by weight, and more preferably 11% by weight to 12% by weight.

In different embodiments, the concentration of the alkyl benzenesulfonate in the surfactant mixture is 15 to 50% by weight, preferably 19% by weight to 35% by weight, more preferably 20% by weight to 30% by weight, and most preferably 26% by weight to 27% by weight.

In different embodiments, the concentration of the alkyl ether sulfate in the surfactant mixture is 20 to 50% by weight, preferably 26% by weight to 42% by weight, more preferably 30% by weight to 40% by weight, and most preferably 34% by weight to 35% by weight.

In different embodiments, the concentration of the fatty alcohol alkoxylate in the surfactant mixture is 15 to 50% by weight, preferably 19% by weight to 35% by weight, more preferably 20% by weight to 30% by weight, and most preferably 26% by weight to 27% by weight.

In different embodiments, the amount of the surfactant mixture based on the weight of the detergent is 2 to 30% by weight, preferably 5 to 25% by weight, more preferably 10 to 20% by weight, and most preferably 14 to 18% by weight.

The employed surfactant mixture contains amine oxide, alkylbenzene sulfonate, alkyl ether sulfate, and fatty alcohol alkoxylate in specific quantity ratios, in each case based on mass. The ratio of amine oxide to alkylbenzene sulfonate is 1:2 to 1:3, preferably 1:2.1 to 1:2.5, and more preferably 1:2.25. The ratio of amine oxide to alkyl ether sulfate is 1:2.5 to 1:3.5, preferably 1:2.8 to 1:3.2, and more preferably 1:2.9. The ratio of amine oxide to fatty alcohol alkoxylate is 1:2 to 1:3, preferably 1:2.1 to 1:2.5, and more preferably 1:2.25.

It has proven advantageous for the cold wash performance if the detergents contain additional soap(s). Preferred detergents therefore are characterized in that, based on the weight thereof, they contain 0.25 to 15% by weight, preferably 0.5 to 12.5% by weight, more preferably 1 to 10% by weight, even more preferably 1.5 to 7.5% by weight, and especially 2 to 6% by weight of soap(s). Especially preferred are soaps of $C_{12}$-$C_{18}$ fatty acids.

The detergents can be detergents for textiles, carpets, or natural fibers. The detergents within the scope of the invention further include washing additives that are dispensed into the actual detergent in manual or automatic textile laundering in order to achieve a further effect. Further, detergents within the scope of the invention also include textile pre- and post-treatment agents, therefore, agents with which the laundered item is brought into contact before the actual laundering, for example, in order to loosen stubborn stains, as well as agents that, in a step following the actual textile laundering, impart to the washed item further desirable properties such as a pleasant feel, absence of creases, or low static charge. Fabric softeners, among others, are included among the latter agents.

Apart from the surfactants: amine oxide, alkylbenzene sulfonate, alkyl ether sulfate, and fatty alcohol ethoxylate, the detergent can contain further anionic or nonionic surfactants. Suitable surfactants are known from the prior art.

In different embodiments, the total amount of nonionic surfactants, based on the weight of the detergent, is 1 to 20% by weight, preferably 2 to 15% by weight, more preferably 2.5 to 12.5% by weight, even more preferably 3 to 11% by weight, and especially 4 to 10% by weight. "Nonionic surfactants" within the meaning of the present invention include, but are not limited to alkyl glycosides, alkoxylated fatty acid alkyl esters, amine oxides, fatty acid alkanolamides, hydroxy mixed ethers, sorbitan fatty acid esters, polyhydroxy fatty acid amides, and alkoxylated alcohols.

In addition, the detergent can contain further ingredients that further improve the application and/or aesthetic properties of the detergent. Within the scope of the present invention, the detergent contains preferably in addition one or more substances from the group comprising enzymes, builders, bleaching agents, electrolytes, nonaqueous solvents, pH adjusting agents, fragrances, perfume carriers, fluorescent agents, dyes, hydrotropes, foam inhibitors, silicone oils, antiredeposition agents, graying inhibitors, shrinkage preventers, anti-creasing agents, dye transfer inhibitors, antimicrobial substances, germicides, fungicides, antioxidants, preservatives, corrosion inhibitors, antistatic agents, bitter agents, ironing aids, hydrophobizing and impregnating agents, swelling and anti-slip agents, softening components, and UV absorbers.

The detergent preferably contains at least one enzyme. In principle, all enzymes established for this purpose in the prior art can be used in this regard. Preferably, these are one or more enzymes, which can display a catalytic activity in a detergent, particularly a protease, amylase, lipase, cellulase, hemicellulase, mannanase, pectin-cleaving enzyme, tannase, xylanase, xanthanase, β-glucosidase, carrageenase, perhydrolase, oxidase, oxidoreductase, and mixtures thereof. Preferred hydrolytic enzymes comprise in particular proteases, amylases, especially α-amylases, cellulases, lipases, hemicellulases, especially pectinases, mannanases, β-glucanases, and mixtures thereof. Proteases, amylases, and/or lipases, and mixtures thereof are especially preferred and proteases are very especially preferred. These enzymes are of natural origin in principle; improved variants based on natural molecules are available for use in detergents and cleaning agents and are accordingly preferred for use.

The enzymes to be used can also be formulated further together with accompanying substances, for instance, from fermentation, or with stabilizers.

Silicates, aluminum silicates (especially zeolites), carbonates, salts of organic dicarboxylic and polycarboxylic acids, and mixtures of these substances in particular can be mentioned as builders that may be present in the detergent.

Organic builders, which may be present in the detergent, are, for example, the polycarboxylic acids that can be used in the form of their sodium salts, polycarboxylic acids being understood to be carboxylic acids that carry more than one acid function. For example, these are citric acid, adipic acid, succinic acid, glutaric acid, malic acid, tartaric acid, maleic acid, fumaric acid, sugar acids, aminocarboxylic acids, and mixtures thereof. Preferred salts are the salts of polycarboxylic acids, such as citric acid, adipic acid, succinic acid, glutaric acid, tartaric acid, sugar acids, and mixtures thereof.

Further, polymeric polycarboxylates are suitable as builders. These are, for example, the alkali metal salts of polyacrylic acid or polymethacrylic acid, for example, those with a relative molecular weight of 600 to 750,000 g/mol.

Suitable polymers are particularly polyacrylates, which preferably have a molecular weight of 1000 to 15,000 g/mol. Because of their superior solubility, from this group in turn the short-chain polyacrylates, which have molar masses of 1000 to 10,000 g/mol, and especially preferably of 1000 to 5000 g/mol, can be preferred.

Suitable furthermore are copolymeric polycarboxylates, particularly those of acrylic acid with methacrylic acid and acrylic acid or methacrylic acid with maleic acid. To improve the water solubility, the polymers can also contain allyl sulfonic acids, such as allyloxybenzenesulfonic acid and methallylsulfonic acid, as monomer.

Soluble builders such as, for example, citric acid, or acrylic polymers with a molar mass from 1000 to 5000 g/mol are used preferably in liquid detergents.

Preferred detergents are liquid or gel-like and preferably contain water as the main solvent. It is preferred in this regard that the detergent contains more than 5% by weight, preferably more than 15% by weight, and especially preferably more than 25% by weight of water, in each case based on the total amount of detergent. Especially preferred liquid detergents contain, based on the weight thereof, 5 to 90% by weight, preferably 10 to 85% by weight, especially preferably 25 to 75% by weight, and especially 35 to 65% by weight of water. Alternatively, the detergents can be low-in-water to water-free detergents, wherein the water content in a preferred embodiment is less than 10% by weight and more preferably less than 8% by weight, in each case based on the total liquid detergent.

In addition, nonaqueous solvents can be added to the detergent. Suitable nonaqueous solvents comprise mono- or polyhydric alcohols, alkanolamines, or glycol ethers, provided these are miscible with water in the indicated concentration range. The solvents are preferably selected from ethanol, n-propanol, i-propanol, butanol, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol monomethyl ether, dipropylene glycol monoethyl ether, methoxytriglycol, ethoxytriglycol, butoxytriglycol, 1-butoxyethoxy-2-propanol, 3-methyl-3-methoxybutanol, propylene glycol t-butyl ether, di-n-octyl ether, and mixtures of said solvents. It is preferred, nevertheless, that the detergent contains at least one alcohol, especially ethanol and/or glycerol and/or 1,2-propanediol, (especially in amounts between 0.5 and 5% by weight, based on the total detergent).

Methods for cleaning textiles are generally notable in that, in multiple method steps, various substances having cleaning activity are applied onto the material to be cleaned and are washed out after the contact time, or that the material to be cleaned is treated in another fashion with a detergent or a solution of said agent.

In the washing methods described herein, in different embodiments of the invention, temperatures of 30° C. or less, for example, 20° C. or less, are used. These temperature specifications relate to the temperatures used in the washing steps.

As already described above, the invention also relates to the use of at least one amine oxide for improving the cleaning performance of a detergent, particularly on greasy stains, whereby the detergent comprises at least one alkylbenzene sulfonate, at least one alkyl ether sulfate, and at least one fatty alcohol alkoxylate. The detergent is preferably a liquid detergent and/or contains the individual surfactant components in the amounts and ratios disclosed above in relation to the detergent.

All facts, subject matters, and embodiments, described for the detergents, are also applicable to the washing method and the use and vice versa.

The liquid detergents described herein can be filled into a water-soluble envelope and thus be part of a water-soluble package. If the liquid detergent is packed in a water-soluble envelope, it is preferable that the water content is less than 10% by weight, based on the total liquid detergent, and that anionic surfactants, if present, are present in the form of the ammonium salts thereof.

Neutralization with amines, unlike in the case of bases such as NaOH or KOH, does not lead to the formation of water. Thus, low-in-water liquid detergents can be produced that are directly suitable for use in water-soluble envelopes.

A water-soluble package contains, in addition to the liquid detergent, a water-soluble envelope. The water-soluble envelope is preferably formed by a water-soluble film material.

Such water-soluble packages can be produced either by vertical form fill seal (VFFS) methods or by thermoforming methods.

The thermoforming method generally includes forming a first layer from a water-soluble film material to create convexities for receiving a composition therein, filling the composition into the convexities, covering the convexities filled with the composition with a second layer of a water-soluble film material, and sealing the first and second layers together at least around the convexities.

The water-soluble envelope, for example, is made from a water-soluble film material selected from the group comprising polymers or polymer mixtures. The envelope can be made of one layer or of two or more layers of the water-soluble film material. The water-soluble film material of the first layer and of the other layers, if present, can be the same or different.

The water-soluble package comprising the liquid washing and the water-soluble envelope can have one or more chambers. The liquid detergent can be contained in one or more chambers, if present, of the water-soluble envelope. The amount of liquid detergent preferably corresponds to the full dose or half the dose necessary for a wash cycle.

It is preferred that the water-soluble envelope contains polyvinyl alcohol or a polyvinyl alcohol copolymer.

Suitable water-soluble films for producing the water-soluble envelope are preferably based on a polyvinyl alcohol or a polyvinyl alcohol copolymer, the molecular weight of which is in the range from 10,000 to 1,000,000 $gmol^{-1}$, preferably from 20,000 to 500,000 $gmol^{-1}$, especially preferably from 30,000 to 100,000 $gmol^{-1}$, and especially from 40,000 to 80,000 $gmol^{-1}$.

Polymers selected from the group comprising acrylic acid-containing polymers, polyacrylamides, oxazoline polymers, polystyrene sulfonates, polyurethanes, polyesters, polyether polylactic acid, and/or mixtures of the above polymers, can be added to a film material that is suitable for producing the water-soluble envelope.

Preferred polyvinyl alcohol copolymers comprise, in addition to vinyl alcohol, dicarboxylic acids as further monomers. Suitable dicarboxylic acid are itaconic acid, malonic acid, succinic acid, and mixtures thereof, itaconic acid being preferred.

Likewise preferred polyvinyl alcohol copolymers comprise, in addition to vinyl alcohol, an ethylenically unsaturated carboxylic acid, the salt thereof, or ester thereof. Especially preferably, such polyvinyl alcohol copolymers contain acrylic acid, methacrylic acid, acrylic acid esters, methacrylic acid esters, or mixtures thereof, in addition to vinyl alcohol.

Suitable water-soluble films for use in the envelopes of the water-soluble packages according to the invention are films marketed by the company MonoSol LLC, for example, under the name M8630, C8400, or M8900. Other suitable films comprise films with the name Solublon® PT, Solublon® GA, Solublon® KC, or Solublon® KL from Aicello Chemical Europe GmbH or the films VF-HP from Kuraray.

The water-soluble packages can have a substantially dimensionally stable spherical and pillow-shaped configuration with a circular, elliptical, square, or rectangular basic form.

The water-soluble package can have one or more chambers for storing one or more agents. If the water-soluble package has two or more chambers, at least one chamber contains the liquid detergent. The further chambers can each contain a solid or a liquid detergent.

EXAMPLES

1. Improvement of the Cleaning Performance

TABLE 1

Liquid detergent composition

| | A (reference) | B | C (reference) | D (reference) |
|---|---|---|---|---|
| C9-13 alkyl benzenesulfonate | 5.5 | 4.5 | 4.5 | 5.0 |
| C12-18 FAEO with 7 EO | 5.5 | 4.5 | 4.5 | 5.0 |
| C12-14 FAEOS with 2 EO | 7 | 5.8 | 6 | 6.5 |
| C12-18 dimethylamine oxide | 0 | 2 | 3 | 1.5 |
| Sum of surfactants [%] | 18 | 16.8 | 18 | 18 |
| C12-18 fatty acid | 3.0 | 3.0 | 3.0 | 3.0 |
| Citric acid | 2.5 | 2.5 | 2.5 | 2.5 |
| Sodium hydroxide | 3 | 3 | 3 | 3 |
| Boric acid | 1 | 1 | 1 | 1 |
| Enzymes | 1 | 1 | 1 | 1 |
| Perfume | 1 | 1 | 1 | 1 |
| Glycerol | 3 | 3 | 3 | 3 |
| Ethanol | 1.5 | 1.5 | 1.5 | 1.5 |
| Optical brightener | 0.05 | 0.05 | 0.05 | 0.05 |
| Phosphonic acid, Na salt | 0.5 | 0.5 | 0.5 | 0.5 |
| Water | To 100 | To 100 | To 100 | To 100 |

All quantities are given in % by weight

As can be gathered from Table 1, a total surfactant content which is about 10% lower is obtained for the detergent composition B of the invention, including soaps.

For the washing tests, domestic washing machines (Miele W1514) were loaded with 3.5 kg of ballast laundry and the stained pieces of cloth. In addition, 70 g/66 mL of the detergent to be tested was metered in and the cotton program was used for washing at 20° C. Detergents A, C, and D from Table 1 were used as reference and compared with detergent B according to the invention. The active surfactant amount (exclusive of soaps) was only 16.8% in detergent B, whereas it was 18% in detergents A, C, and D. Detergents C and D contain 3% or 1.5% amine oxide.

After drying by hanging and pressing of the material pieces, the whiteness thereof was determined by spectrophotometry (Minolta CR400-1).

The results are given in Table 2 and are averages of 6 determinations. The measured values are given as the difference between the reflectance values and the reference formulation A. Positive values indicate an improvement in the washing performance and a greater washing out of the spot in comparison with the reference.

The soiled textiles were purchased or prepared.

The results in Table 2 show that formulation D with an 18% surfactant content and 1.5% amine oxide exhibits no improvement versus A. Formulation C with a likewise 18% surfactant content and 3% amine oxide has both positive and negative effects, because the lipstick stain could be removed less well with this detergent than with reference detergent A. Only the composition of the invention shows exclusively positive effects. It can be clearly gathered from Table 2 that the use of amine oxide in a specific ratio to alkylbenzene sulfonate, alkyl ether sulfate, and fatty alcohol ethoxylate, as defined herein, results in considerable improvement in the cleaning performance on greasy stains. Moreover, detergent B with a lower total surfactant content exhibits an improved performance versus formulations A, C, and D.

TABLE 2

Cleaning performance on different stains

| Type of stain | B 2% amine oxide | C (reference) 3% amine oxide | D (reference) 1.5% amine oxide |
|---|---|---|---|
| Beef fat | 5.8 | 4.8 | 2.3 |
| Lipstick | 1.9 | −3.0 | 1.6 |
| Butter, dyed red | 14.5 | 9.3 | 6.2 |
| Margarine, dyed red | 4.3 | 4.3 | 3.0 |

2. Liquid Detergent with Improved Cleaning Performance

TABLE 3

Liquid detergent composition

| | E |
|---|---|
| C9-13 Alkyl benzenesulfonate | 4.90 |
| C12-18 FAEO with 7 EO | 4.90 |
| C12-14 FAEOS with 2 EO | 6.20 |
| C12-18 dimethylamine oxide | 2.00 |
| Sum of surfactants [%] | 18.00 |
| C12-18 fatty acid | 2.00 |
| Citric acid | 2.20 |
| Sodium hydroxide | 2.60 |
| Boric acid | 1.00 |
| Enzymes | 1.00 |
| Perfume | 1.00 |
| 1,2-Propylene glycol | 3.00 |
| Ethanol | 2.00 |
| Optical brightener | 0.04 |
| Phosphonic acid, Na salt | 0.50 |
| Water | To 100 |

All quantities are given in % by weight

The liquid detergent E according to Table 3 had a slightly improved cleaning performance compared with detergent B in Table 1.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A detergent containing a surfactant mixture, wherein the surfactant mixture comprises:

a) 10% by weight to 15% by weight of a C12-C18 alkyl-di(C1-C4 alkyl)amine oxide, b) 20% by weight to 30% by weight of a linear or branched C9-19 alkylbenzene sulfonate, c) 30% by weight to 40% by weight of a C12-20 alkyl ether sulfate with 2-8 EO, and d) 20% by weight to 30% by weight of a C12-C20 fatty alcohol ether with 2-8 EO, in each case based on the surfactant mixture, wherein i. the weight ratio of amine oxide to alkylbenzene sulfonate is 1:2.1 to 1:2.5, ii. the weight ratio of amine oxide to alkyl ether sulfate is 1:2.8 to 1:3.2, and iii. the weight ratio of amine oxide to fatty alcohol alkoxylate is 1:2.1 to 1:2.5.

2. The detergent according to claim 1, characterized in that the detergent, based on the total amount of the detergent, contains the surfactant mixture in an amount of 2 to 30% by weight.

3. The detergent according to claim 1, characterized in that the detergent contains further soaps.

4. The detergent according to claim 3, characterized in that the detergent contains 0.25 to 15% by weight, of soap(s).

5. The detergent according to claim 1, characterized in that the detergent in liquid form is present in a water-soluble envelope.

6. A washing method comprising the process steps:

i. providing a wash solution comprising a detergent according to claim 1, ii. bringing a textile into contact with the wash solution according to (i).

* * * * *